US008052218B2

(12) United States Patent
Grove

(10) Patent No.: US 8,052,218 B2
(45) Date of Patent: Nov. 8, 2011

(54) NO-TOOLS SEAT PLATE ASSEMBLY WITH SEAT LIFT GAS CYLINDER RECEIVER

(76) Inventor: James E. Grove, Marina Del Rey, CA (US)

( * ) Notice: Subject to any disclaimer, the term of this patent is extended or adjusted under 35 U.S.C. 154(b) by 126 days.

(21) Appl. No.: 12/655,486

(22) Filed: Jan. 4, 2010

(65) Prior Publication Data

US 2011/0163584 A1 Jul. 7, 2011

(51) Int. Cl.
*A47C 7/02* (2006.01)

(52) U.S. Cl. ..... 297/440.22

(58) Field of Classification Search ..... 297/440.22
See application file for complete search history.

(56) References Cited

U.S. PATENT DOCUMENTS 3,823,980 A * 7/1974 Harnick ..... 297/452.14
3,851,920 A * 12/1974 Harris et al. ..... 297/452.55 X
4,099,774 A * 7/1978 Sandham ..... 297/440.22 X
5,035,466 A * 7/1991 Mathews et al. ..... 297/337
5,102,196 A * 4/1992 Kaneda et al. ..... 297/452.15
5,106,157 A * 4/1992 Nagelkirk et al. ..... 297/344.19
5,192,114 A * 3/1993 Hollington et al. ..... 297/300.5
5,314,240 A * 5/1994 Ishi et al. ..... 297/452.15
5,318,346 A * 6/1994 Roossien et al. ..... 297/300.1
5,630,643 A * 5/1997 Scholten et al. ..... 297/440.15 X
5,662,381 A * 9/1997 Roossien et al. ..... 297/440.22 X
5,755,488 A * 5/1998 Beda et al. ..... 297/337
5,810,439 A * 9/1998 Roslund, Jr. ..... 297/300.4
5,842,264 A * 12/1998 Roossien et al. ..... 297/440.22 X
5,909,924 A * 6/1999 Roslund, Jr. ..... 297/300.4
5,934,758 A * 8/1999 Ritch et al. ..... 297/452.54
6,010,194 A * 1/2000 Cykon ..... 297/440.22
6,015,187 A * 1/2000 Roslund et al. ..... 297/300.4
6,027,169 A * 2/2000 Roslund, Jr. ..... 297/440.22 X
6,135,556 A * 10/2000 Chu et al. ..... 297/337
6,224,160 B1 * 5/2001 Takeuchi et al. ..... 297/440.15
6,279,998 B1 * 8/2001 Chu et al. ..... 297/440.22
6,499,801 B1 * 12/2002 Peterson et al. ..... 297/440.22 X
6,634,711 B2 * 10/2003 Phillips et al. ..... 297/337
6,935,698 B1 * 8/2005 Chen ..... 297/440.22
7,014,269 B2 * 3/2006 Coffield et al. ..... 297/440.2 X
7,066,537 B2 * 6/2006 Coffield et al. ..... 297/284.4
7,159,942 B2 * 1/2007 Costaglia ..... 297/337 X
7,341,233 B2 * 3/2008 McMains ..... 248/424
7,478,880 B2 * 1/2009 Johnson et al. ..... 297/342
7,530,640 B2 * 5/2009 Walters et al. ..... 297/440.22
7,648,115 B2 * 1/2010 Lambert et al. ..... 248/429
2007/0284930 A1 * 12/2007 Christianson et al. ..... 297/440.22 X

* cited by examiner

*Primary Examiner* — Rodney B. White
(74) *Attorney, Agent, or Firm* — Morland C. Fischer

(57) ABSTRACT

A seat plate assembly that is secured without the use of tools or special skill to the bottom of a seat of a home or office chair that is sold disassembled. The no-tools seat plate assembly includes a seat plate housing that is connected to and slidable along the seat relative to a catch and a cam lock that is pivotally connected to and rotatable relative to the seat plate housing. The seat plate housing has a gas cylinder receiver in which to receive a gas lift cylinder. When the seat plate housing is first connected to the seat, the cam lock is rotated over top the gas cylinder receiver to block receipt of the gas cylinder. During installation, the seat plate housing slides axially along the seat, and the cam lock is rotated into locking engagement with the catch. The gas cylinder receiver is now unblocked to accept the gas cylinder therewithin.

21 Claims, 6 Drawing Sheets

NO-TOOLS SEAT PLATE ASSEMBLY WITH SEAT LIFT GAS CYLINDER RECEIVER

BACKGROUND OF THE INVENTION

1. Field of the Invention

This invention relates to a seat plate assembly that can be connected, without the use of tools, to the bottom of a seat during the assembly of a chair that is shipped disassembled from the manufacturer. The no-tools seat plate assembly includes a gas cylinder receiver that is initially blocked to prevent a premature attachment of a seat lift gas cylinder until the seat plate assembly has first been securely connected to the seat.

2. Background Art

To conserve shipping space and reduce shipping costs, it is known to ship articles of furniture in a disassembled condition. Thus, the furniture can be shipped from the manufacturer to the retailer and carried to a home or office by the purchaser in a compact shipping container. One such piece of furniture that is suitable to be shipped disassembled is a chair of the kind having wheels, a base, a seat and a backrest. The elevation of the seat relative to the base can be selectively adjusted by the user. To accomplish the foregoing, a lever arm is manually manipulated by the user to control the operation of a seat lift gas cylinder that is typically mounted at the bottom of the seat.

Following purchase of the chair just described, the purchaser is often required to use tools (e.g., wrenches) and special skill to complete the assembly process prior to use. The assembly process may prove to be difficult and time consuming which can lead to frustration on the part of the purchaser. Moreover, it is desirable that the seat lift gas cylinder be interfaced with the seat at a particular time during assembly to avoid an early and inadvertent operation of the cylinder.

Therefore, it would be advantageous to have a seat plate assembly that includes a gas cylinder receiver and a gas cylinder operating lever arm and which is capable of being reliably connected to the bottom of a seat during the assembly of a chair sold disassembled without the use of tools or special skill. It would also be advantageous to be able to prevent attachment of the seat lift gas cylinder to the gas cylinder receiver until such a time as the seat plate assembly has first been securely connected to the seat.

SUMMARY OF THE INVENTION

Briefly, and according to a preferred embodiment, a seat plate assembly is disclosed that can be attached without the use of tools or special skill to the bottom of a seat of a home or office chair that is sold disassembled. The no-tools seat plate assembly includes a seat plate housing to which a rotatable cam lock is connected. The seat plate assembly is attached to a set of bolts which stand upwardly from the bottom of the seat bottom for receipt through respective keyholes formed in the seat plate housing. The seat plate housing includes a gas cylinder receiver to which a conventional seat lift gas cylinder is to be attached to selectively control the elevation of the seat above the ground.

The rotatable cam lock of the seat plate assembly is rotatable relative to the seat plate housing. The rotatable cam lock has a blocking tongue located at one end thereof and a cam base plate located at the opposite end. An opening is formed through the blocking tongue and a cam blade is carried by the cam base plate. When the seat plate assembly is first attached to the seat, the rotatable cam lock is initially rotated in a first direction and into contact with a first stop such that the blocking tongue extends over and blocks access to the gas cylinder receiver, whereby to prevent attachment of the seat lift gas cylinder to the receiver. At the same time, the cam blade of the cam base plate is rotated out of engagement with a cam surface formed on a catch that is mounted at the rear of the seat bottom.

The seat plate housing of the seat plate assembly is pushed rearwardly over the seat and towards the catch at the rear of the seat bottom to cause the upstanding bolts to ride through the keyholes in the housing. The rotatable cam lock is then rotated in an opposite direction and into contact with a second stop, such that the opening through the blocking tongue is now located above and axially aligned with the gas cylinder receiver. The cam blade of the cam base plate is correspondingly rotated against the cam surface of the catch, whereby the rotatable cam lock and the catch are disposed in interlocking engagement to prevent the seat plate housing from moving away from the catch and forwardly over the seat. The seat lift gas cylinder is finally attached to the gas cylinder receiver of the seat plate housing by way of the opening in the blocking tongue of the rotatable cam lock. The receipt of the gas cylinder by the gas cylinder receiver via the opening in the blocking tongue prevents a rotation of the cam lock out of its interlocking engagement with the catch.

DESCRIPTION OF THE PREFERRED EMBODIMENT

Figure 1:
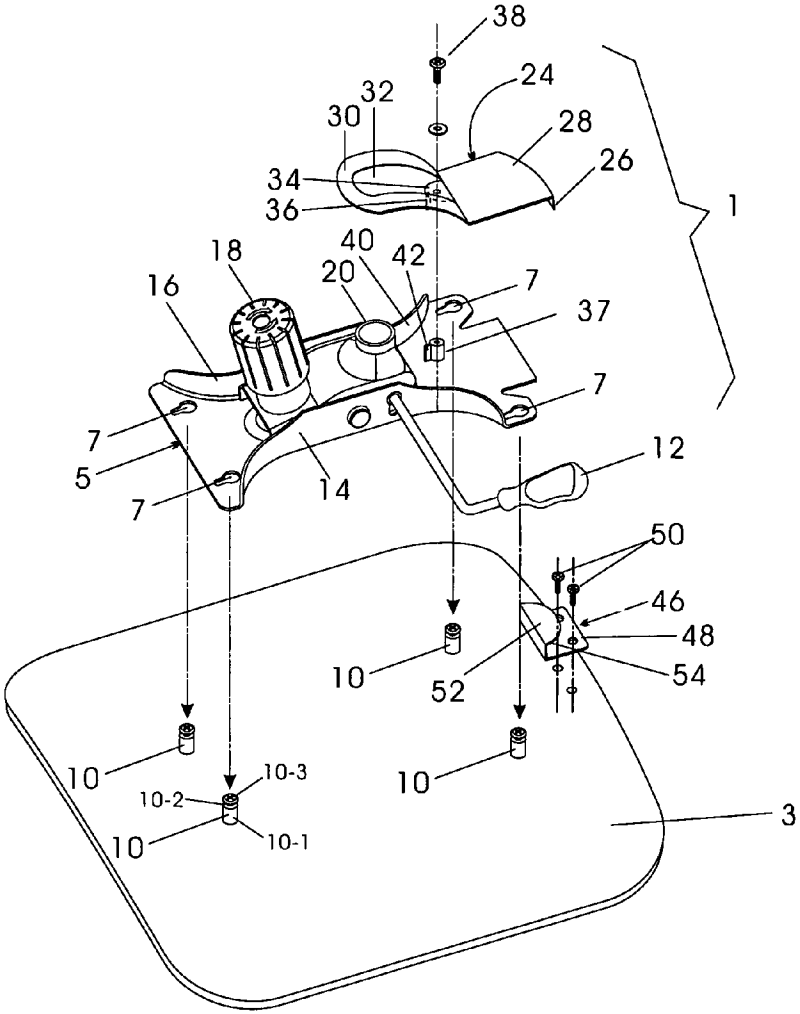
FIG. 1 is an exploded view of a seat plate housing and a rotatable cam lock for a no-tools seat plate assembly to be connected to the bottom of a seat during the assembly of a chair sold disassembled.

A no-tools seat plate assembly 1 according to a preferred embodiment of this invention is initially described while referring to FIG. 1 of the drawings. As will be explained in greater detail hereinafter, the seat plate assembly 1 can be easily attached without the use of tools or special skill to the bottom of a seat 3 during the assembly of a home or office chair of the kind that is sold disassembled. As will also be explained, the seat plate assembly 1 has a unique blocking feature that prevents the premature attachment of a seat lift gas cylinder that is common to many home and office chairs.

The seat plate assembly 1 includes a generally-rectangular seat plate housing 5. A set of (e.g., four) key holes 7 are formed through respective corners of the seat plate housing 5. The keyholes 7 are sized and shaped to receive therethrough a corresponding set of shoulder bolts 10 that are affixed to and stand upwardly from the bottom of the seat 3.

A conventional lever arm 12 projects laterally through one upturned wall 14 of a pair of upturned walls 14 and 16 at opposite sides of the seat plate housing 5. Once the seat plate assembly 1 is fully attached to the bottom of seat 3, the lever arm 12 can be manually manipulated by the user to selectively adjust the height and tilt of the seat 3 above the floor. A conventional tension knob 18 is manually accessible at the seat plate housing 5. The tension control knob 18 can be manually rotated to adjust the spring tension below the seat 3 depending upon the weight of the user.

A cylindrical gas cylinder receiver 20 projects upwardly from the seat plate housing 5. The gas cylinder receiver 20 is sized to receive therewithin a conventional seat lift gas cylinder (designated 60 in FIG. 5). The lever arm 12 cooperates with the gas cylinder following the attachment of the seat plate assembly 1 to the bottom of the seat 3 to enable the elevation of the seat to be adjusted to suit the needs of the user. However, as an important detail of this invention, the gas cylinder cannot be installed within the gas cylinder receiver 20 until the seat plate assembly 1 has first been completely and securely attached to the seat 3.

Figure 1A:
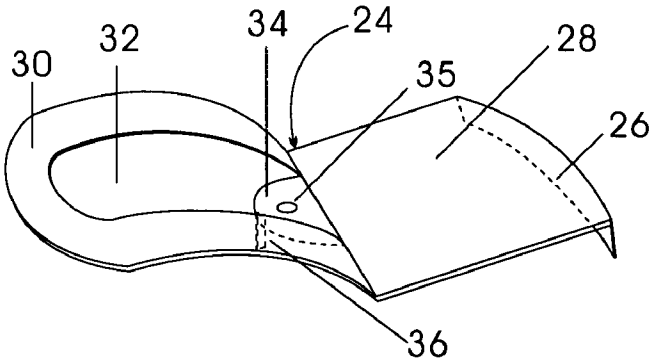
FIG. 1A is an enlarged showing of the rotatable cam lock of the no-tools seat plate assembly of FIG. 1.

To this end, and referring concurrently to FIGS. 1 and 1A of the drawings, the seat plate assembly 1 also includes a rotatable cam lock 24. An arcuate cam blade 26 is affixed (e.g., welded) to and projects downwardly from a flat cam base plate 28 located at one end of the cam lock 24. A blocking tongue 30 bends upwardly and outwardly from the cam base plate 28 at the opposite end of the cam lock 24. The blocking tongue 30 of cam lock 24 has an opening 32 formed therethrough. The opening 32 through blocking tongue 30 is sized and shaped to accommodate therethrough the seat lift gas cylinder 60 (of FIG. 5) as will soon be described.

A tab 34 having a hole 35 formed therein depends from the cam base plate 28 of the rotatable cam lock 24. The tab 35 is accessible through the opening 32 of blocking tongue 30. A blocking pin 36 projects downwardly from the tab 34. A threaded boss 37 (best shown in FIG. 1) stands upwardly from the seat plate housing 5. The seat plate assembly 1 is completed when the rotatable cam lock 24 is pivotally connected to the seat plate housing 5. That is, the tab 34 of cam lock 24 is located above with the threaded boss 37 of seat plate housing 5, and a threaded fastener (e.g., a bolt) 38 is inserted by way of the opening 32 of tongue 30 through the hole 35 in the tab 34 and into boss 37. The fastener 38 is secured to the seat plate housing 5 so that the rotatable cam lock 24 is adapted to rotate at the fastener 38 over the housing 5 for an important purpose that will soon be described. It is preferable that cam lock 24 be connected to the seat plate housing 5 to complete the seat plate assembly 1 prior to shipment to reduce the assembly requirements of the purchaser.

The seat plate housing 5 of seat plate assembly 1 includes a pair of stops by which to limit the rotation of the cam lock 24 at fastener 38 in opposite directions over the housing 5. A first stop 40 is located at one end of the side wall 16. The first stop 40 lies rearwardly of the gas cylinder receiver 20. A second stop 42 (shown in FIG. 1) is a nub that is formed at the front of the threaded boss 37 and spaced inwardly from the first stop 40.

Figure 1B:
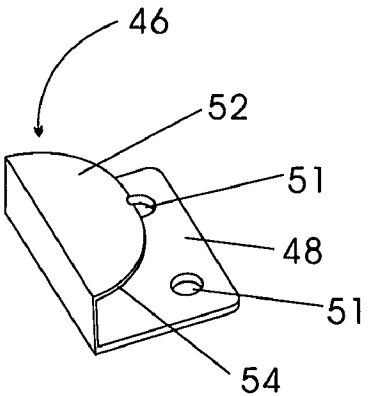
FIG. 1B is an enlarged showing of a catch that is mounted on the bottom of the seat of FIG. 1.

To enable the seat plate assembly 1 to be securely and reliably attached to the bottom of the seat 3 in order to be able to receive the seat lift gas cylinder during the chair assembly, a catch 46 is mounted on the bottom of the seat 3 adjacent the rear edge thereof. Referring concurrently to FIGS. 1 and 1B of the drawings, the catch 46 includes a catch plate 48 that is affixed (by means of fasteners 50 inserted through holes 51) to seat 3. A cam receiver 52 having an arcuate cam surface 54 is spaced above the catch plate 48. The curved shape of the cam surface 54 of the cam receiver 52 of the catch 46 of FIG. 1B conforms to the curved shape of the cam blade 26 of the cam base plate 28 of the rotatable cam lock 24 of FIG. 1A.

Figure 2:
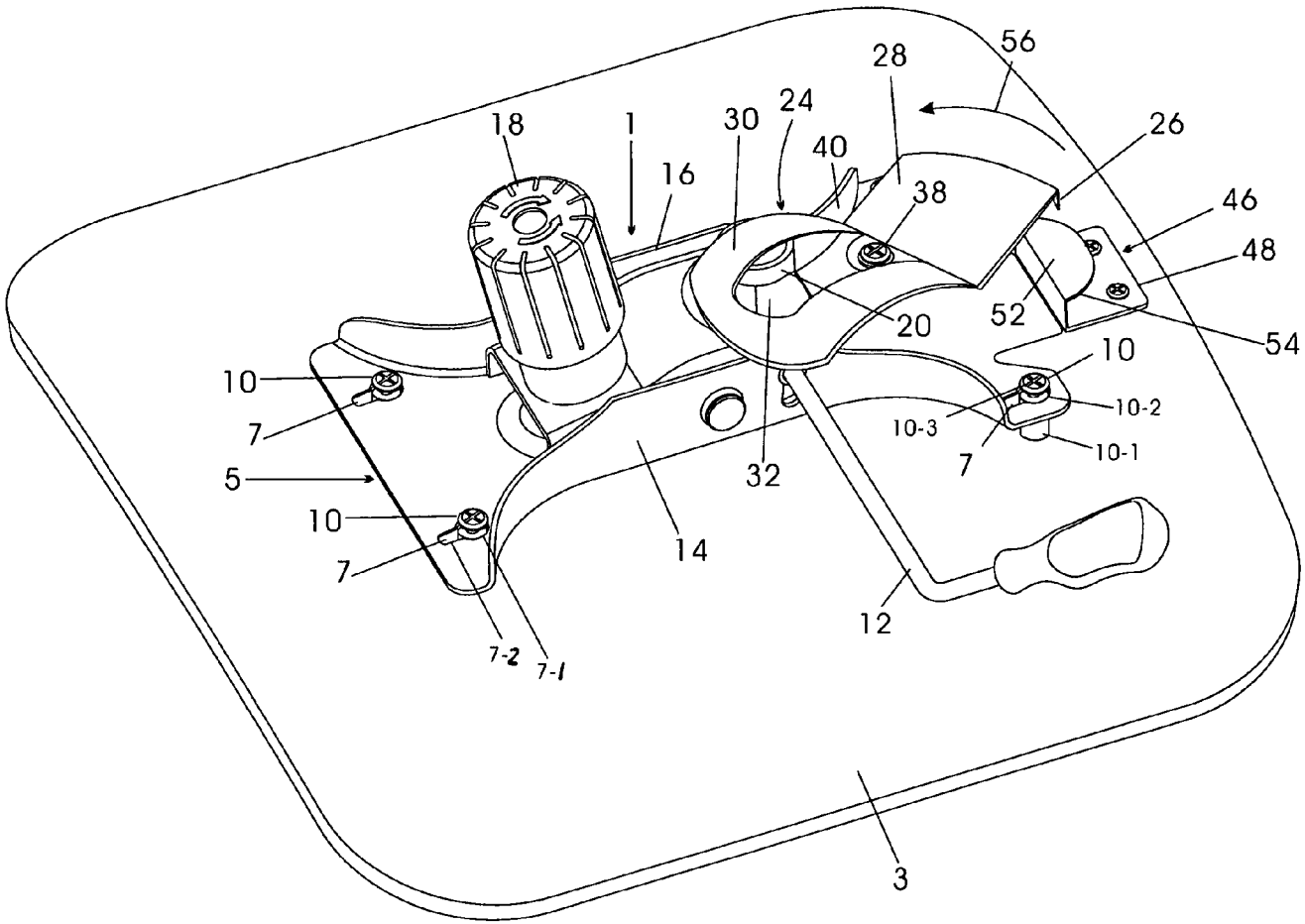
FIG. 2 shows the no-tools seat plate assembly after it is initially laid against the bottom of the seat with the rotatable cam lock rotated out of engagement with the catch.

FIG. 2 of the drawings shows the no-tools seat plate assembly 1 of FIG. 1 during its movement into locking engagement with the bottom of the seat 3. In order to connect the seat plate assembly 1 (which includes the combination of the rotatable cam lock 24 connected to the seat plate housing 5) to the seat 3, the upstanding bolts 10 of seat 3 are first located within respective ones of the key holes 7 of the seat plate housing 5 (as previously described). Each key hole 7 has a relatively wide drop-in head 7-1 at one end thereof and a relatively narrow locking tail 7-2 at the opposite end. It may be appreciated that the seat plate housing 5 of assembly 1 is simply pushed towards and laid over the seat 5 such that the bolts 10 are received within the wide drop-in heads 7-1 of key holes 7.

Each bolt 10 has a relatively wide body 10-1, a relatively narrow neck 10-2 standing above the body 10-1 and a cap 10-3 carried by the neck 10-2. When the seat plate assembly 1 is initially pushed into engagement with the bottom of the seat 3, the housing 5 will rest upon the wide bodies 10-1 of bolts 10, and the caps 10-3 and the narrow necks 10-2 of bolts 10 are passed through the wide drop-in heads 7-1 of the keyholes 7.

When the seat plate assembly 1 is first pushed into engagement with the seat 3, the rotatable cam lock 24 is rotated at pivot fastener 38 in a first (counter clockwise) direction represented by the reference arrow 56 relative to the seat plate housing 5 so that the cam base plate 28 is moved against and intercepted by the first stop 40 at side wall 16, and the blocking tongue 30 is correspondingly moved over top the gas cylinder receiver 20 of housing 5. In other words, during the initial step of connecting the seat plate assembly 1 to the bottom of seat 3, the cam lock 24 is positioned (i.e., rotated) so that the gas cylinder receiver 20 is covered to prevent the (premature) insertion of the seat lift gas cylinder (60 of FIG. 5) until such a time as when the seat plate assembly 1 is completely and reliably connected to seat 3 in a manner to be described.

What is more, when the cam lock 24 is rotated in the first direction against the first stop 40, the cam lock 24 is disengaged from the catch 46. In particular, the cam blade 26 that is carried by the cam base plate 28 is correspondingly rotated away from the cam surface 54 at the cam receiver 52 of catch 46. In this case, the cam base plate 28 is seated on top of the cam receiver 52, and the cam blade 26 is located in front and separated from the cam surface 54.

Figure 3:
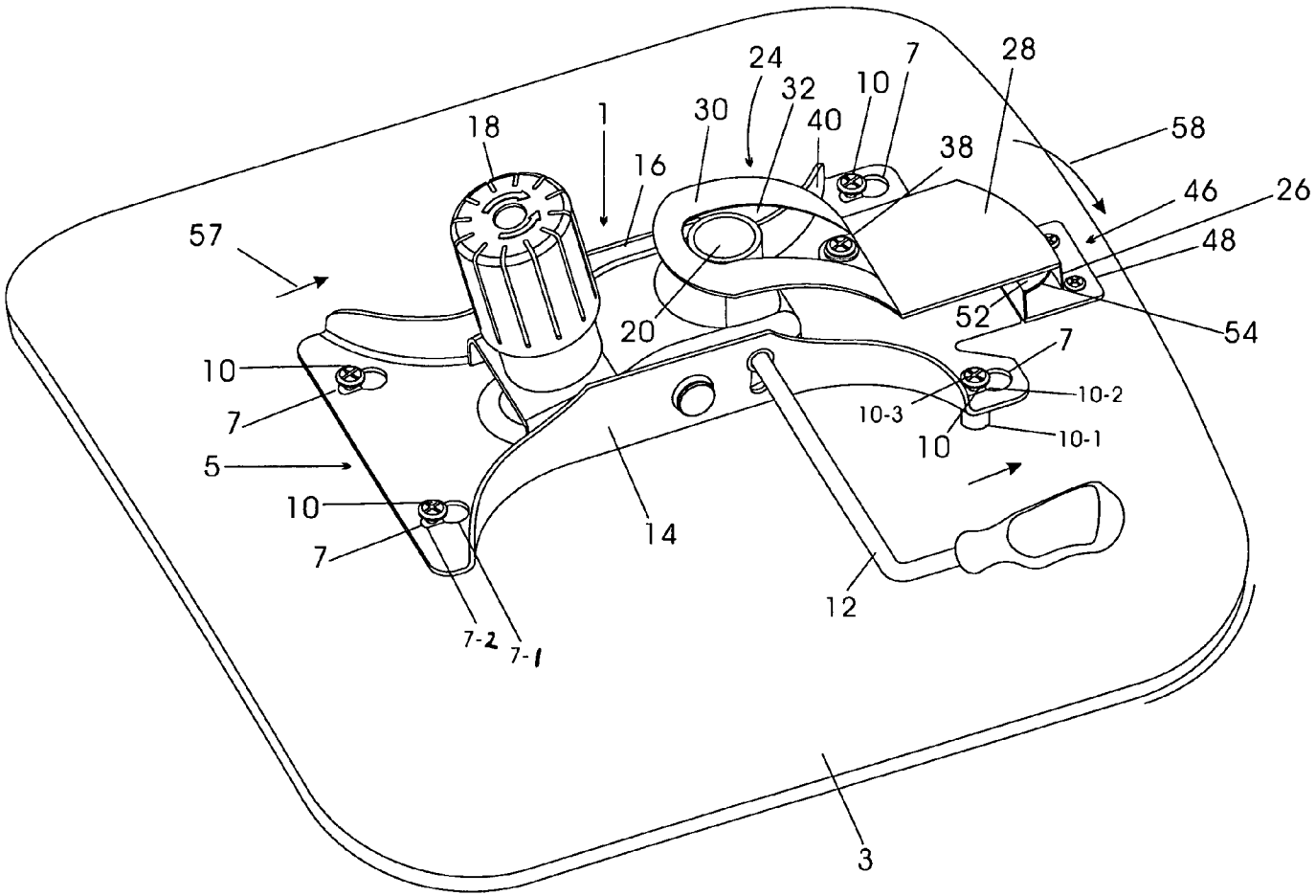
FIGS. 3 and 4 show the no-tools seat plate assembly after it is moved over the bottom of the seat and the rotatable cam lock is rotated into interlocking engagement with the catch.
Figure 4:
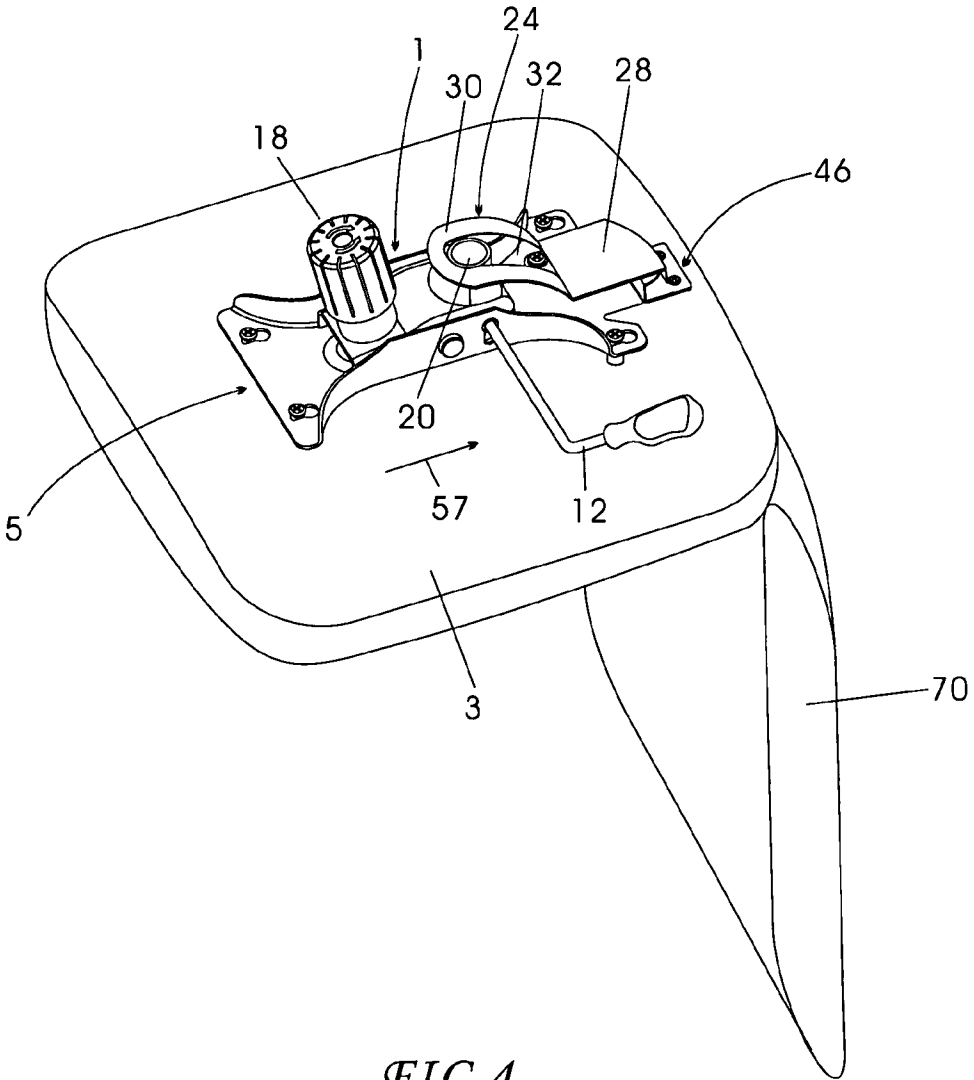

Next, and referring to FIGS. 3 and 4 of the drawings, a pushing force is applied to the no-tools seat plate assembly 1 to cause the assembly to move rearwardly over the bottom of seat 3 in the direction of the reference arrows 57 towards the catch 46 and the back rest 70 of the chair. As the assembly 1 moves, the keyholes 7 that are formed in the seat plate housing 5 are correspondingly moved. Thus, the upstanding bolts 10 will ride through respective keyholes 7 until the relatively narrow necks 10-2 of bolts 10 are relocated from the wide drop-in heads 7-1 to the narrow tails 7-2 of the keyholes 7. With the seat plate housing 5 positioned between the wide bodies 10-1 and the caps 10-3 of bolts 10, the seat plate assembly 1 cannot be pulled off the bolts 10 and removed from the bottom of the seat 3.

The rearward displacement of the seat plate assembly 1 over the seat 3 causes the rotatable cam lock 24 to move towards the catch 46. A pushing force is now applied to the rotatable cam lock 24 of the seat plate assembly 1 to cause the cam lock 24 to rotate at the pivot fastener 38 over the seat plate housing 5 in a clockwise direction indicated by reference arrow 58. As the cam lock 24 rotates, the cam base plate 28 thereof is correspondingly rotated away from the first stop 40 at the side wall 16 and towards the catch 46. At the same time, the blocking tongue 30 is rotated (in the direction of reference arrow 58) with the cam base plate 28 until the blocking pin 36 (of FIGS. 1 and 1A) that is carried by the rotatable cam lock 24 is moved into contact with the second stop (i.e., nub) 42 (of FIG. 1) at the front of the threaded boss 37. The blocking pin 36 strikes the second stop 42 to prevent further rotation of the rotatable cam lock 24 in the clockwise direction. At this time, the blocking tongue 30 is automatically positioned so that the opening 32 thereof lies directly above and in axial alignment with the gas cylinder receiver 20 of seat plate housing 5. In other words, the blocking tongue 30 is now repositioned relative to the gas cylinder receiver 20 to permit the receiver 20 to accept the gas cylinder 60 (of FIG. 5) through opening 32.

In addition, and referring concurrently to FIGS. 1A, 1B and 3, the cam base plate 28 of the rotating cam lock 24 slides over the cam receiver 52 of the catch 46, and the cam blade 26 of cam lock 24 rides around the cam surface 54 of catch 46. With the cam blade 26 and the cam surface 54 communicating with and lying against one another as shown in FIG. 3, the rotatable cam lock 24 and the catch 46 will be disposed in interlocking engagement. Accordingly, the seat plate assembly 1 cannot be pulled forwardly over the seat plate housing 5 (in a direction opposite the direction indicated by the reference arrows 57 of FIG. 3) and away from catch 46.

Figure 5:
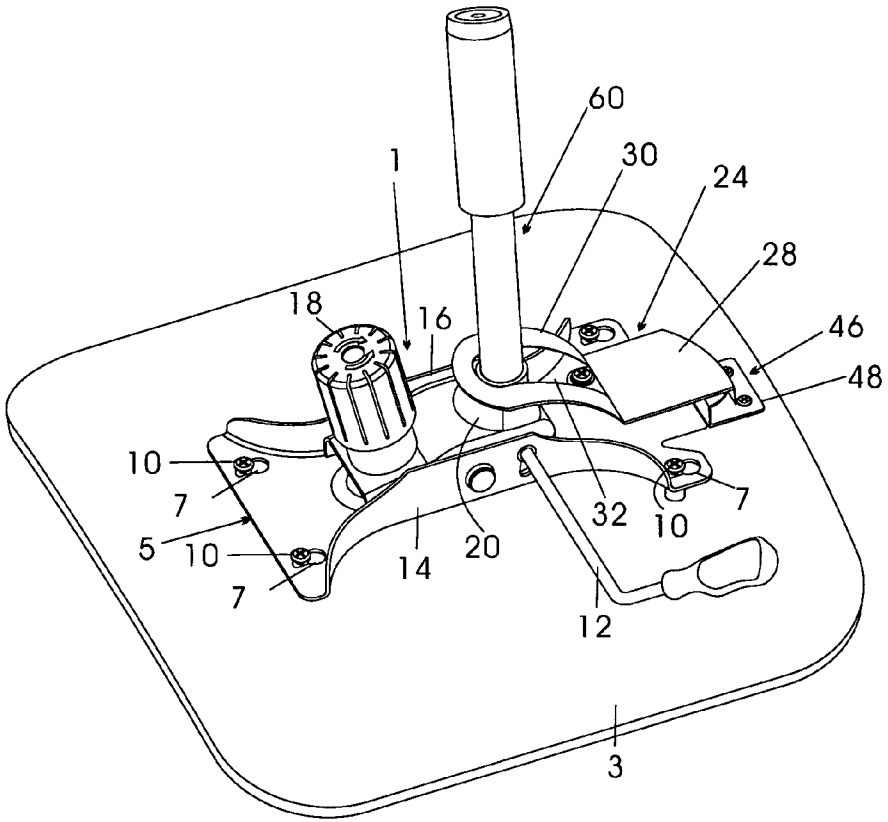
FIG. 5 shows the no-tools seat plate assembly of FIGS. 3 and 4 with a seat lift gas cylinder attached to a gas cylinder receiver of the seat plate housing.

With the no-tools seat plate assembly 1 held in place against the bottom of the seat 3 as just explained and the opening 32 of blocking tongue 30 positioned over and aligned with the gas cylinder receiver 20, the gas lift cylinder 60 is now attached to the receiver 20. Referring in this regard to FIG. 5 of the drawings, the gas lift cylinder 60 is shown after being moved through the opening 32 in blocking tongue 30 and attached to the gas cylinder receiver 20. Once the gas cylinder 20 is passed through opening 32 and attached to receiver 20, the blocking tongue 30 can no longer be rotated in any direction, and, therefore, the seat plate assembly 1 cannot be moved out of its interlocking engagement with the catch 46.

The seat plate assembly 1 is now fixedly attached to the bottom of the seat 3. It may be appreciated that the foregoing is completed without the use of tools as is often required during the assembly of other chairs. It may also be appreciated that the seat plate assembly 1 is attached by means of a few pushing steps which reduces the time and inconvenience associated with assembly.

The invention claimed is:

1. A chair assembly comprising a seat, a seat plate housing to be attached to said seat, said seat plating housing having a seat lift gas cylinder receiver, a seat lift gas cylinder to be received by said seat lift gas cylinder receiver for controlling the elevation of said seat above the ground, and a locking body attached to said seat plate housing and being movable between first and second positions with respect to said seat plate housing, said locking body being moved to said first position at which to prevent the receipt of said seat lift gas cylinder by said seat lift gas cylinder receiver.

2. The chair assembly recited in claim 1, wherein said locking body is moved to said second position at which to allow the receipt of said seat lift gas cylinder by said seat lift gas cylinder receiver.

3. The chair assembly recited in claim 2, wherein said locking body is pivotally attached to said seat plate housing so that said locking body is rotatable relative to said seat lift gas cylinder receiver between said first and second positions.

4. The chair assembly recited in claim 3, wherein said locking body has an opening through which to receive said seat lift gas cylinder, said locking body being rotated to said first position at which the opening in said locking body is out of axial alignment with the seat lift gas cylinder receiver such that said locking body blocks the attachment of said cylinder to said receiver, and said locking body being rotated to said second position at which the opening of said locking body is axially aligned with the seat lift gas cylinder receiver such that said cylinder is attached to said receiver by way of the opening of said locking body.

5. The chair assembly recited in claim 4, wherein said seat plate housing also has first and second stops, said locking body being rotated against said first stop at said first position, and said locking body being rotated against said second stop at said second position.

6. The chair assembly recited in claim 2, wherein there are a plurality of fasteners standing upwardly from said seat and there are a corresponding plurality of holes formed in said seat plate housing for receiving respective ones of said fasteners when said seat plate housing is attached to said seat.

7. The chair assembly recited in claim 6, wherein each of said plurality of holes formed in said seat plate housing has a wide drop-in head and a locking tail which is narrower than said wide drop-in head, said seat plate housing being laid upon said seat at a first location such that said plurality of fasteners are received through the wide drop-in heads of said plurality of holes, and said seat plate housing being moved over said seat and relocated to a second location at which said fasteners are received through and retained by the narrow locking tails of said holes, whereby said seat plate housing is attached to said seat.

8. The chair assembly recited in claim 7, wherein said seat plate housing is attached to said seat without the use of tools.

9. The chair assembly recited in claim 7, further comprising a catch attached to said seat, said locking body adapted to be moved into interlocking engagement with said catch in order to prevent said seat plate housing from moving over said seat from said second location to said first location.

10. The chair assembly recited in claim 9, wherein said locking body is moved into said interlocking engagement with said catch at the same time that said locking body is moved from said first position to said second position with respect to said seat plate housing.

11. The chair assembly recited in claim 10, wherein said locking body has a cam blade and said catch has a cam surface, said cam blade being moved over and against said cam surface after said seat plate housing is first moved from said first location to said second location and when said locking body is moved from said first position to said second position and into said interlocking engagement with said catch.

12. A method for assembling a chair including a seat, a seat lift gas cylinder to control the elevation of said seat above the ground, a seat plate housing having a seat lift gas cylinder receiver to receive said seat lift gas cylinder, and a body coupled to said housing and being movable between first and second positions relative to said seat lift gas cylinder receiver, said method comprising the steps of:

laying said seat plate housing against said seat;

moving said body to said first position at which to prevent said seat lift gas cylinder receiver from receiving said seat lift gas cylinder;

attaching said seat plate housing to said seat; and moving said body to said second position at which to permit said seat lift gas cylinder receiver to receive said seat lift gas cylinder.

13. The method recited in claim 12, including the additional step of rotating said body to said first and second positions relative to said seat lift gas cylinder receiver.

14. The method recited in claim 12, wherein said body has an opening formed therein, said method including the additional step of moving said body to said first position at which said opening is out of axial alignment with said seat lift gas cylinder receiver in order to block the receipt of said seat lift gas cylinder by said receiver.

15. The method recited in claim 14, including the additional step of moving said body to said second position at which the opening in said body is axially aligned with said seat lift gas cylinder to permit the receipt of said cylinder by said receiver.

16. The method recited in claim 15, including the additional step of connecting said seat lift gas cylinder to said seat lift gas cylinder receiver by way of the opening in said body, the connection of said cylinder to said receiver preventing the movement of said body from said second position to said first position.

17. The method recited in claim 12, wherein the step of attaching said seat plate housing to said seat includes the additional steps of laying said seat plate housing against said seat such that fasteners projecting from said seat are located through respective holes formed in said seat plate housing, each of said holes having a wide drop-in head at which said fasteners are initially received and a locking tail which is narrower than said drop-in head; and moving said seat plate housing in a first direction along said seat for causing said fasteners to be received and retained at the narrow locking tails of said holes to prevent said seat plate housing from being removed from said seat.

18. The method recited in claim 17, wherein said seat plate housing is attached to said seat without the use of tools.

19. The method recited in claim 17, wherein said body includes a locking end and said seat includes a catch, said method including the additional step of moving said locking end into interlocking engagement with said catch at the same time that said body is moved to said second position, whereby to prevent said seat plate housing from moving in an opposite direction along said seat.

20. The method recited in claim 19, wherein the locking end of said body is a cam blade and wherein said catch has a cam surface, said method including the additional step of moving said cam blade over and against said cam surface, whereby said locking end and said catch are located in said interlocking engagement.

21. A chair assembly comprising a seat, a catch attached to said seat, a seat plate housing to be attached to said seat, said seat plate housing having a seat lift gas cylinder receiver to receive a seat lift gas cylinder by which to control the elevation of said seat above the ground, and a locking body attached to said seat plate housing and movable between unlocked and locked positions with respect to said catch, said locking body being moved to the unlocked position at which to be disengaged from said catch and thereby permit a displacement of said seat plate housing relative to said seat, and said locking body being moved to the locked position and into locking engagement with said catch to thereby prevent a displacement of said seat plate housing relative to said seat.

* * * * *